United States Patent [19]

Gregory et al.

[11] Patent Number: 4,735,357

[45] Date of Patent: Apr. 5, 1988

[54] MODULAR WATER FACUET WITH AUTOMATIC WATER SUPPLY SYSTEM

[75] Inventors: Stephen O. Gregory, 2508 Arapahoe St., Denver, Colo. 80205; Garry L. Atkins, Aurora, Colo.

[73] Assignee: Stephen O. Gregory, Denver, Colo.

[21] Appl. No.: 837,409

[22] Filed: Mar. 7, 1986

[51] Int. Cl.[4] ..... E03C 1/05; B67D 5/37

[52] U.S. Cl. ..... 236/93 R; 4/623; 137/801; 251/367

[58] Field of Search ..... 251/366, 367; 236/93 R; 137/801, 603, 898, 607; 361/179; 4/623

[56] References Cited

U.S. PATENT DOCUMENTS

| | | | |
|---|---|---|---|
| 3,275,036 | 9/1966 | Spencer | 137/607 X |
| 3,406,941 | 10/1968 | Ichimori et al. | 251/129.01 |
| 3,480,787 | 11/1969 | Johansen | 4/623 X |
| 4,635,673 | 1/1987 | Gerdes | 137/801 X |

*Primary Examiner*—William E. Wayner
*Attorney, Agent, or Firm*—Gregg I. Anderson

[57] ABSTRACT

A modular water faucet, which includes a base operatively connected to a spout. The base and spout each have a cubical design and include thereon means for mounting decorative panels of various design and/or color. The modules making up the base can be stacked to any desired height, and the spouts are interchangeable with the base. The water faucet includes an automatic control system for dispensing water upon the sensing of a human body or other object near an outlet of the spout. The control system uses infrared light to detect the presence of an object. Means for differentiating the reflected light from ambient light are included. Water temperature is also sensed and compared to a preselected temperature. Water is prevented from flowing if the temperature is in excess of the preselected temperature and warnings are given in an automatic mode. Water flow will proceed if a manual mode is initiated. The control system also detects the position of the spout relative to the base. If the spout is turned through a preset angle to the side, then water flow is forced off for maintenance. A mixing valve is operated by a slide passing through the base to preset the temperature of the water supplied. A manual override is provided in the automatic water faucet in the event of a power outage.

11 Claims, 8 Drawing Sheets

MODULAR WATER FACUET WITH AUTOMATIC WATER SUPPLY SYSTEM

BACKGROUND OF THE INVENTION

1. Field of the Invention

The present invention relates to water faucets for use in lavoratories of businesses and residences. More particularly, the present invention relates to water faucets which include an automatic control system for sensing the presence of an object, such as the human body, or a portion thereof, near the faucet and for starting and stopping the water flow from the water faucet based on sensing the presence of the object.

2. Description of the Prior Art

Water faucets for use in a lavatory, particularly in residences, are a decorative, as well as functional, item. Designers and manufacturers utilize different metallic finishes to provide differing decorative enhancements to such water faucets, chrome and brass finishes being among the more popular. Clear or colored plastic, is sometimes used on the handles to provide a contrast with the spout. In years past, porcelain was sometimes used on the valve handles of water faucets.

Much has been done to provide artistic shapes to spouts, body portions and valve handles of water faucets. Heretofore, no known water faucet has included decorative panel inserts for the spout and for the body or base of the water faucet.

Commercially available faucets are purchased as predefined units. Typically, replacement parts are available, but the overall appearance of the faucet is fixed and can only be changed by purchase of a new faucet. Spouts which are interchangeable with the body portion, changing the appearance of the faucet, have not been previously available.

In the preferred embodiment of the water faucet of the present invention, an automatic water supply control system operates by sensing the presence of a person's hands. Infrared rays are emitted from the area of a water outlet, reflected and sensed in the vicinity of the outlet of the spout to turn the water faucet on and off. M. Ichimori, et al. (U.S. Pat. No. 3,406,941) discloses a water flow control system, which detects capacitance rather than reflected infrared light to initiate water flow. Another automatic water flow control system for a water faucet is seen in M. Teshima (U.S. Pat. No. 3,151,340). A time delay circuit is added to an automatic water supply control system in T. Ishikawa (U.S. Pat. No. 3,575,640). Other automatic water supply or flushing systems are seen in T. Tanaka (U.S. Pat. No. 3,588,038) and C. Atkins, et al. (U.S. Pat. No. 3,314,081). Other touch responsive and sensing apparatus are seen in C. Atkins, et al. (U.S. Pat. No. 3,254,313); D. Elam (U.S. Pat. No. 2,922,880) and C. Atkins, et al. (U.S. Pat. No. 3,081,594). A switch-activated hand washing device is seen in J. Lesher, et al. (U.S. Pat. No. 3,358,747).

Commercially available automatic water control systems have additional features not shown in the prior art patents referenced above. Infrared light activated faucets are known, though such faucets do not have means for differentiating stray light and therefore often turn on when no one is near the outlet. It is known to have a switch for overriding the infrared induced automatic control system to supply a continuous water flow. In case of power failure, a manual bypass system providing for manual operation of the valve of an automatic faucet is also known.

Some conventional water supply systems also include an antiscald feature, which will prevent water above a certain predetermined temperature from flowing. In such faucets, high temperature water is not available when the water supply temperature is in excess of the predetermined temperature.

A slide valve structure for mixing hot and cold water to select the appropriate temperature has not heretofore been used in connection with a water suppy system, a push-pull mixing valve having been previously used. A swivelable spout, which will rotate 180° but has an automatic shutoff once a predetermined angle has been exceeded, has not been shown previously in connection with an automatic water supply faucet.

OBJECTS AND SUMMARY OF THE INVENTION

It is an object of the present invention to provide a water faucet of a basic modular structure and cubic shape which is expandable into other cubic shapes.

It is a related object of the related invention to provide a water faucet of modular structure adapted to have mounted thereon different spout configurations and/or decorative panels to change the overall appearance of the water faucet.

It is another object of the present invention to provide a faucet with an automatic water supply control system using reflected infrared light to detect the presence of an object near an outlet of the spout and to differentiate reflected infrared light from light reflected from other sources.

It is a further object of the present invention to provide a water faucet with an automatic water supply control system which can easily be adjusted by the infirmed or handicapped to a set water temperature.

It is another further object of the present invention to provide a manually operated spray wash which uses water at a selected water temperature diverted from the water faucet.

It is another further object of the present invention to provide a water faucet with an automatic water supply control system which has a variable water flow rate controller for an aerator.

It is still another object of the present invention to provide a water faucet with an automatic water supply control system that is turned off when a spout of the water faucet is rotated to a predetermined angular position.

It is a still further object of the present invention to provide a water faucet with an automatic water supply control system operating by a solenoid valve, which water faucet is manually operable in the event of power failure.

It is a still further object of the present invention to provide a water faucet with an automatic water supply control system which warns the user and prevents the flow of water in excess of a predetermined temperature in the automatic mode, but which then permits the water flow in excess of the predetermined temperature in a manual mode after having previously warned the user.

In accordance with the objects of the invention, a modular water faucet includes a main body portion made up of one or more modules selectively connected to each other and then to one of a group of interchangeable spouts or spigots. The various components of the water faucet are of a cubic configuration, which is utilized, in one instance, to add or delete modules from the main body to raise or lower the height of the water spout. In addition, the cubical structure of the spout and modules of the main body portion have mounted thereon rectangular and square decorative panels of selected colors and/or designs. The final result is a customized faucet of unique appearance, which appearance can be altered by adding or deleting modules and/or changing spouts.

The spout is swivelly connected to an inner valve body mounted within the main body. The spout carries therein water, and a sealed conduit for electrical conductors of an automatic water supply control system. A swivel connector between the spout and main body directs water between the spout and a mixing valve. The electrical conduit passes through the connector to carry the conductors to a control circuit mounted in the interior of the modules of the main body.

The main body and spout contain therein the water supply control system for selectively turning the water faucet on and off and for controlling the temperature of the water supplied thereby, various operational and safety features being incorporated into such a system. A water supply pipe passes through standard holes in a sink basin with which the water faucet is associated bringing separate hot and cold water lines into the water control system. The mixing valve, which is often mounted within the modules, receives the water and mixes the water to establish the desired temperature of the water. A slide of the mixing valve passes through the main body to allow the user of the water faucet to adjust the mixing valve and thereby the temperature of the water supplied by the faucet and a separate optional spray wash.

A water conduit directs the mixed water from the mixing valve, through the inner valve body, and to a solenoid valve. A water passageway extending from the solenoid valve, through the swivel connection between the spout and the valve body and along the interior of the spout, conducts water to a water outlet adjacent to an infrared emitter and an infrared sensor mounted at an end of the spout.

A variable water flow control device is mounted in a water chamber of the spout to regulate the flow of water in an automatic mode of operation. Water leaves the spout through an aerator mounted at the spout outlet. The electrical conductors connect the infrared sensor and emitter to the control circuit through the conductor conduit, which control circuit is operatively connected to a solenoid which operates the solenoid valve.

The control circuit includes a microprocessor which receives information from the infrared sensor and emitter and turns the faucet on and off in the automatic mode by activating the solenoid when certain conditions are present. The microprocessor is programmed so that the infrared emitter and infrared sensor sample light in the vicinity of the outlet to insure that random light from sources other than the emitter does not turn the faucet on. The microprocessor also receives a water supply temperature input which is used by the microprocesser to establish whether the water supply temperature is sufficiently low that the faucet can be operated safely in the automatic mode.

The spout is swivelable on the valve body by and through the swivel connector and the control circuit turns the water flow off when the spout is rotated to a certain angle away from a normal operating position. The lavoratory and sink area can then be cleaned without turning the water faucet on.

The faucet has a manually activated on-off switch which is used to turn on the faucet for continuous water flow in a manual mode of operation. In the manual mode the faucet can be turned on even if the water supply temperature is in excess of the predetermined temperature. In the event of power failure, the faucet is manually operated by a drain cap knob.

DESCRIPTION OF THE PREFERRED EMBODIMENT

Figure 5:
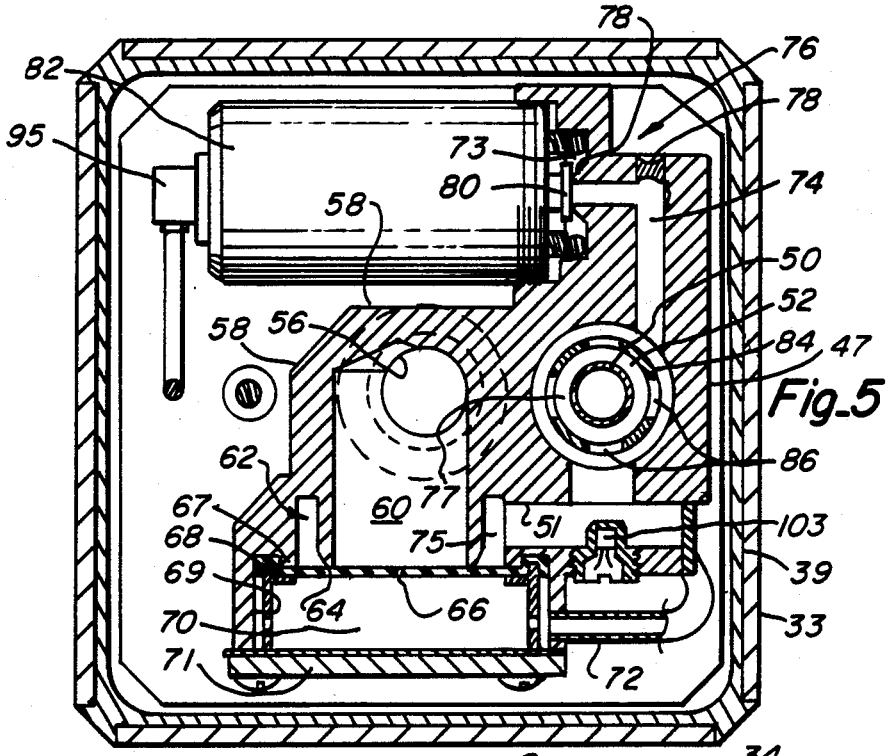
FIG. 5 is a sectional view taken in the plane of line 5—5 of FIG. 4.
Figure 4:
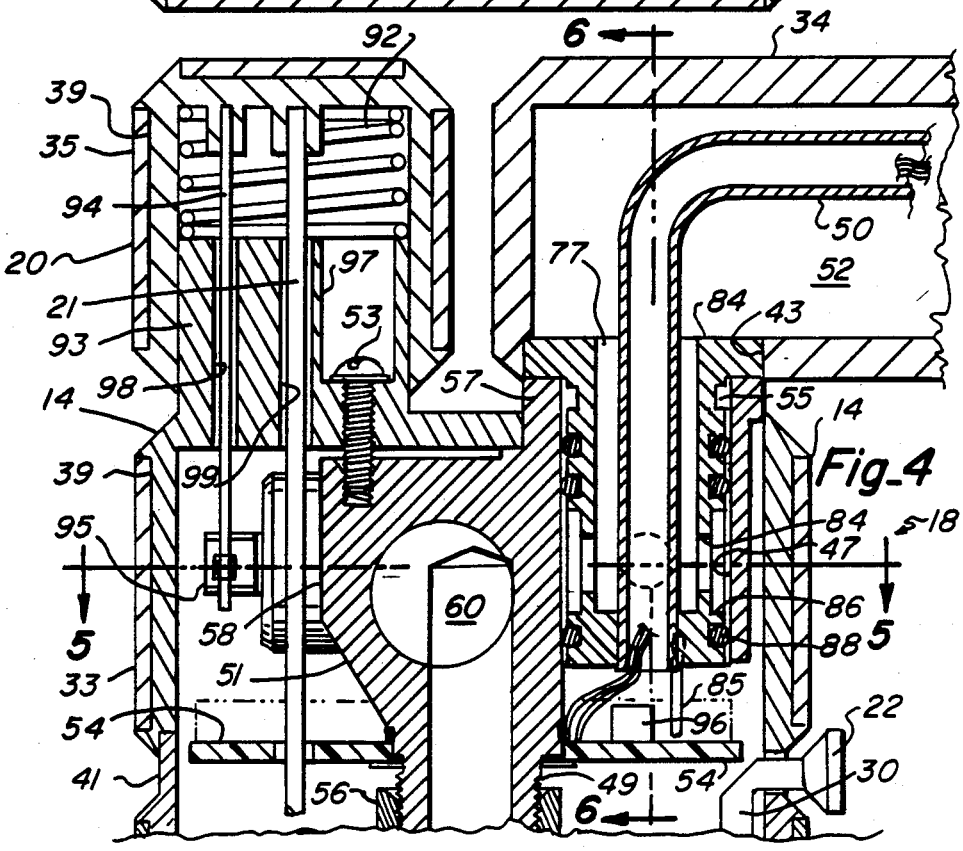
FIG. 4 is an enlarged fragmentary sectional view of the invention shown in FIG. 1.

An automatic water faucet 10 of modular construction is seen in the drawing figures. The water faucet 10 has an elongated spout or spigot 34 swivelly connected to an inner valve body 51 mounted within a main body 18 of modular construction. The main body includes a lower module 12 and an upper module 14 secured in place relative to each other. The lower and upper modules 12 and 14 have a square cross section. (FIG. 5). The lower module 12 is of tubular configuration, open at either end. The upper module 14 is open where it connects with the lower module to define the interior of the main body 18. (FIG. 4). The lower module 12 is conventionally secured to a sink 16 through which module 12 a water supply is received as will be described.

A drain cap knob 20 is slidably connected for vertical movement on the upper module 14. The knob 20 operates a drain plug (not shown) in the sink in a conventional manner and, in a manual override mode of the automatic faucet 10, operates the faucet 10 by overriding the automatic mode and manual mode on-off controls. The manual override mode is used primarily in the event of a power failure.

Figure 2:
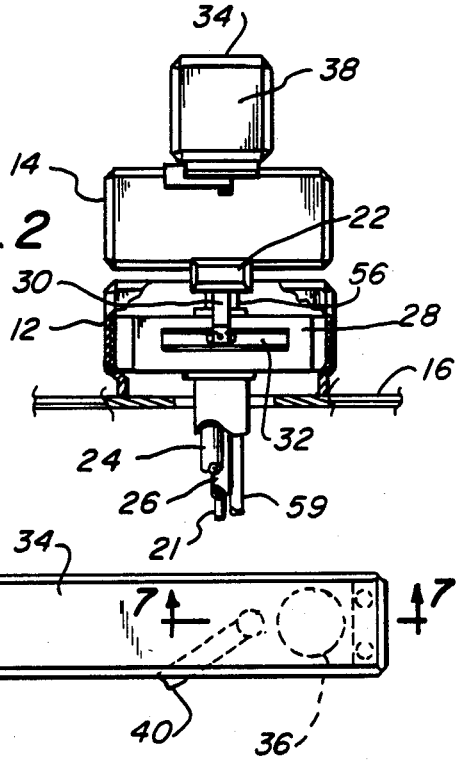
FIG. 2. is a front elevational view of the invention shown in FIG. 1, portions broken away for clarity.
Figure 3:
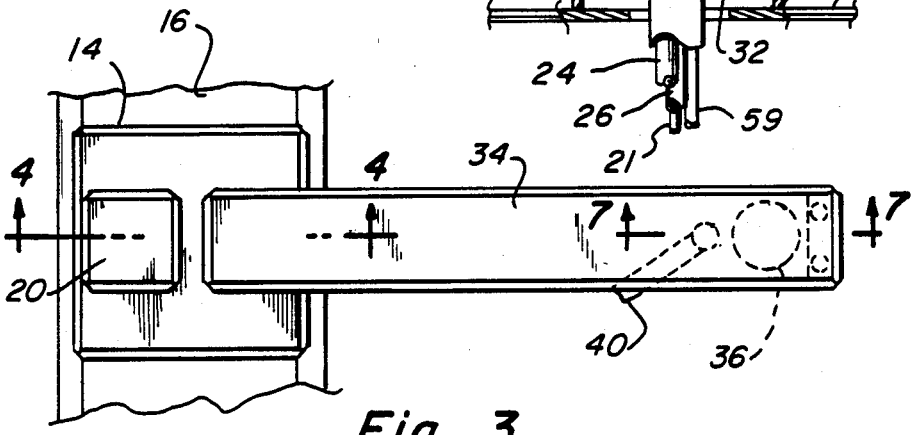
FIG. 3 is a top plan view of the invention shown in FIG. 1.

A hot water supply pipe 24 and cold water supply pipe 26, each with conventional one way check valves to prevent back flow (not shown) and screens to prevent entrance of foreign particles, pass through the sink 16 into the interior of the lower module 12 of the main body 18, where a mixing valve 28 is mounted. (FIG. 2). A slide 22, which operates the mixing valve 28, projects from between the connection between the upper and lower modules 12 and 14 to the front of the water faucet 10. The slide 22 is connected by a connecting rod 30, passing through a slide opening 32 in the main body 18, to the slide valve. (FIG. 4). Moving the slide 22 of the mixing valve 28 sets the temperature at which water will be supplied by the faucet 10 in either the automatic mode or the manual mode. A return pipe 59 (FIG. 2) may divert the premixed water away from the slide valve 28 through a conventional diverter valve (not shown) to a separate spray wash (not shown).

Figure 7:
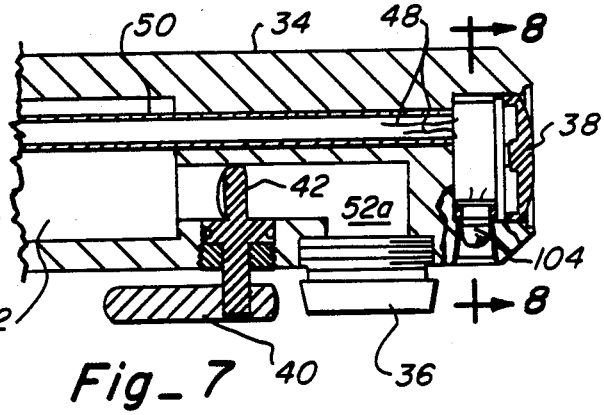
FIG. 7 is a fragmentary sectional view of a spout of the invention shown in FIG. 1.

At a terminal end of the spout 34 an outlet nozzle aerator 36 is threadably connected to the spout at a bottom surface thereof. A flow control valve 42, turned between open and closed positions by a flow control knob 40, governs the flow rate of water out of the nozzle 36. (FIG. 7). In the open position a high flow rate occurs and in the closed position a low flow rate occurs. A manually activated push button switch 38 is retained in a tip of the spout 34 to turn the faucet 10 on and off in the manual mode. Activation of the switch 38 turns the faucet 10 on, the faucet staying on until the switch 38 is depressed a second time. The flow control valve 42 also controls the water flow rate in the manual mode.

Figure 8:
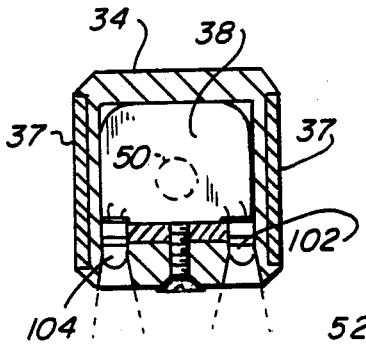
FIG. 8 is a sectional view taken in the plane of line 8—8 of FIG. 7.
Figure 10:
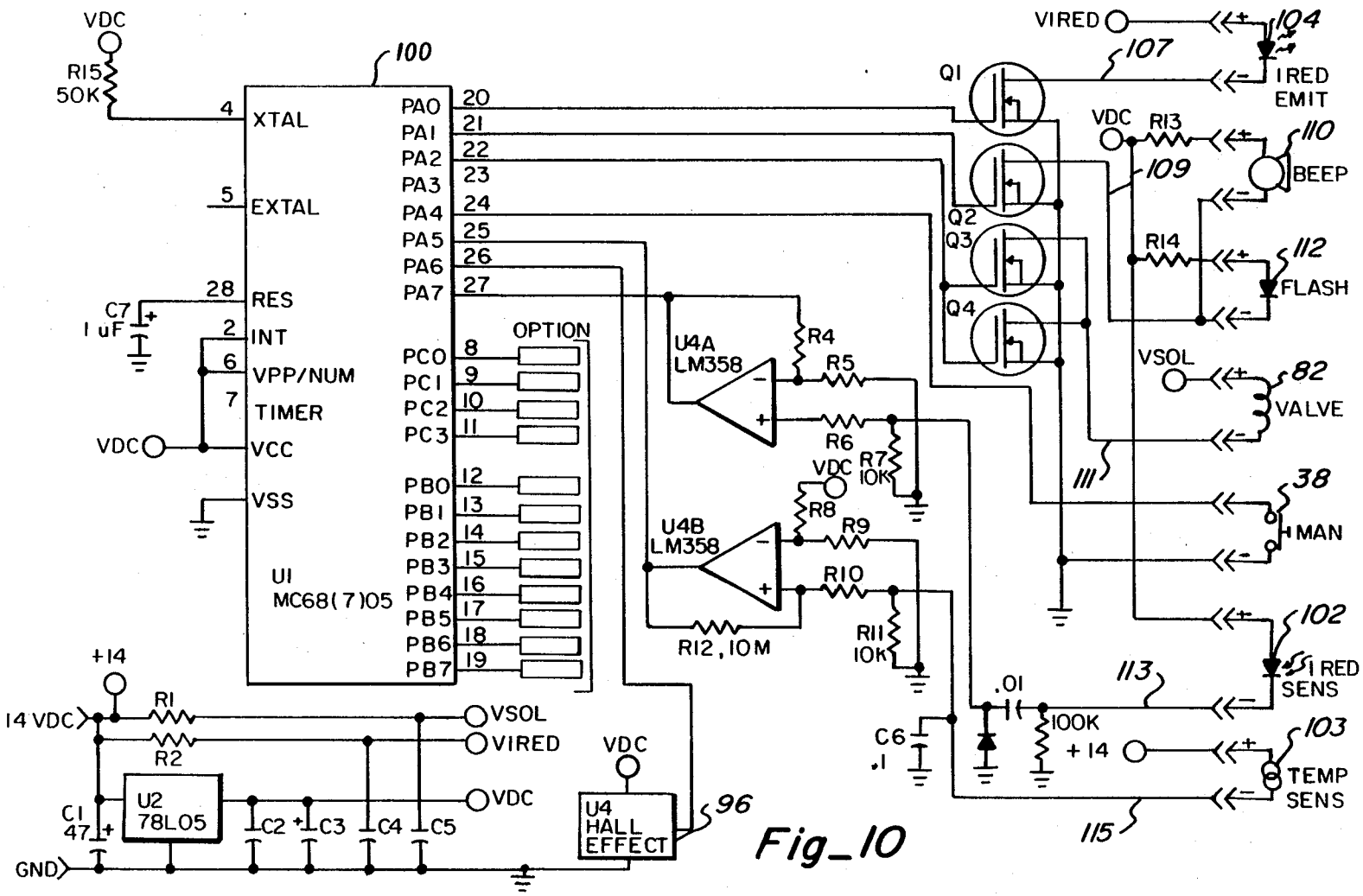
FIG. 10 is a circuit diagram of the control circuit for the invention shown in FIG. 1.

Automatic mode activation is accomplished by sensing the presence of an object, such as a human hand, near the outlet aerator 36. Light from an infrared emitter 104 reflected off the object is sensed by an infrared sensor 102 mounted adjacent the outlet aerator. (FIGS. 7 and 8). The sensor provides an input signal carried by electrical conductors 48 carried in an electrical conduit 50 of the spout 34 from the sensor to a control circuit 54 in the main body 18. (FIGS. 4 and 10). The electrical conduit 50 is mounted for swivelable movement with the spout 34 relative to the main body 18. The conduit 50 extends parallel to a water chamber 52 formed in the spout 34.

The control circuit 54 is wired to available AC building supply voltage, through a transformer and DC power supply (not shown). Fourteen (14) volts DC is supplied to the circuit in the preferred embodiment. (FIG. 10). In the automatic mode, a microprocessor 100 of the control circuit receives input information from the infrared sensor 102 and turns the water faucet 10 on or off, depending on whether an object is sensed near the aerator 36. Removal of an object from the area of the sensor 102 will result in water flow stopping as soon as the emitter 104 is again turned on and the sensor 102 fails to receive any reflected light.

The infrared emitter 104 transmits periodic pulses of infrared light to be reflected off any object near the emitter, and the reflected light is sensed by the sensor 102. The microprocessor, sensor 102 and emitter 104 are timed by a program of the microprocessor 100 to differentiate between reflected infrared light from the emitter and ambient light from other light sources that might turn the faucet 10 on.

Water supplied is sensed for temperature by water supply temperature sensor 103 (FIGS. 5 and 6) and this information is inputted to the microprocessor 100. The water supply sensor 103 supplies current, which is linear in proportion to the temperature of the water being sensed. The sensor is set to change one microamp per degree Kelvin. The sensor 103 is held within passageway 75 by a threaded connection. (FIG. 5). Insulating material surrounds the sensor 103 so that an average water supply temperature is sensed and the heat generated by metal parts does not interfere with the accuracy of the readings. Water flow in the automatic mode is prevented when a certain predetermined temperature is exceeded. This feature prevents the possibility of using the faucet 10 in the automatic mode with the temperature so high that a person's hand is scalded. Audio and visual warnings are also provided, by beeper 110 and LED 112 seen in FIGS. 1 and 10. The hot water can still be accessed, after the warnings have been given, by conscious resort to the manual mode and operation of switch 38.

Figure 9:
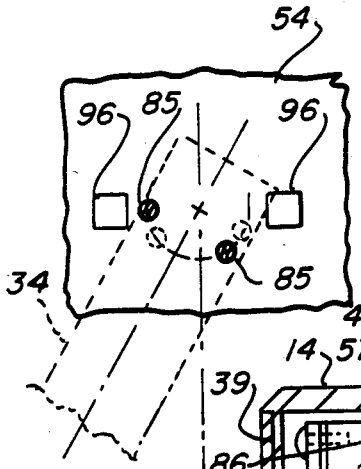
FIG. 9 is a schematic view showing the spout in phantom line in a swivelable relationship to a fixed control circuit board of the invention shown in FIG. 1.

The microprocessor 100 of the control circuit 54 also forces water flow off in response to the position of the spout 34. When the spout 34 is swiveled far enough to one side or the other so that the aerator 36 is to the back of the sink 16, water flow is forced off in both the automatic and manual modes. (FIG. 9).

Figure 1:
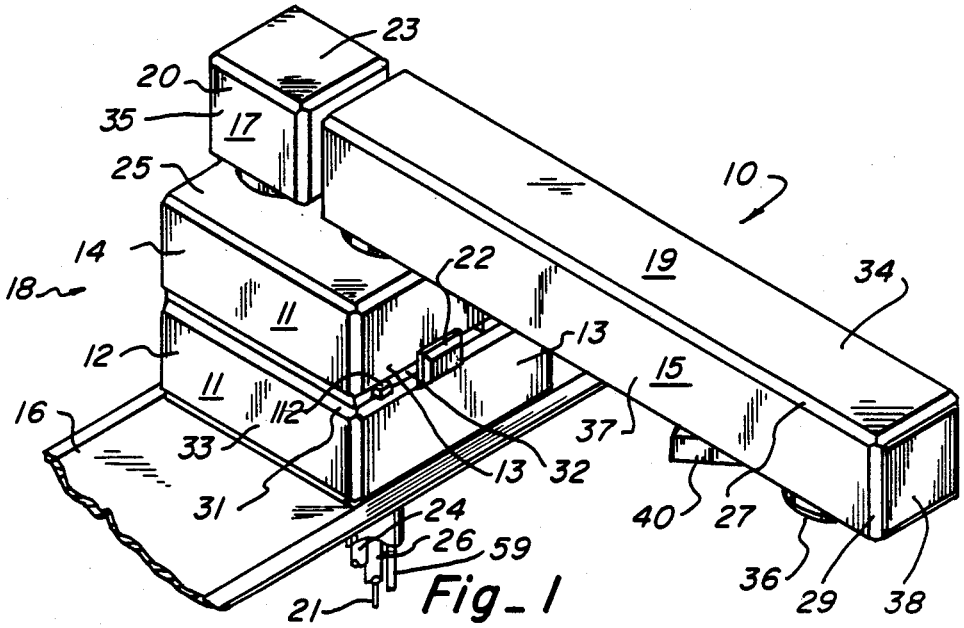
FIG. 1 is a perspective view of an automatic modular water faucet of the present invention.

The modules 12 and 14, drain cap knob 20 and spout 34 are shaped and constructed so as to provide for different sized faucets of unique appearance. (FIG. 1). Side module vertical surfaces 11 are coplanar between the lower and upper modules 12 and 14 and are in parallel planes with side spout vertical surfaces 15 and knob side vertical surfaces 17. In a like manner, front modular vertical surfaces 13 of the upper and lower modules 12 and 14 are coplanar with each other and in parallel planes to like surfaces on the spout and drain cap knob 20. Spout horizontal surface 19 is parallel and coplanar to knob horizontal surface 23 which are in turn parallel to the module horizontal surface 25. Spout chamfers 27 are formed between the horizontal surface 19 and side surface 15. A tip chamfer surface 29 is formed on the spout 34 and module chamfer surfaces 31 are formed on the main body 18.

The module surfaces 11 and 13, the drain cap surfaces 17 and the spout surfaces 15 are defined by decorative inserts 33, 35 and 37 respectively. (FIGS. 1, 4, 5 and 8). The decorative inserts 33, 35 and 37 are glued or epoxied into recessed areas 39 (FIG. 4) in the respective modules 12 and 14, the knob 20 and the spout 34.

The lower module 12 includes an upwardly projecting skirt 41 which is insertable into the upper module 14. Once the modules 12 and 14 are fitted together, a screw 53 passes through a hole in the upper module 14 to threadably secure to the inner valve body 51. The valve body 51 is connected to the mixing valve 28 which is secured to the pipes 24 and 26, holding the entire faucet 10 in place. (FIG. 4). The screw 53 is covered by the knob 20, which knob is slideable along a projection 93 of the upper module 14. The projection 93 has a counterbore 97 formed along a longitudinal axis thereof through which counterbore the screw 53 is inserted through the screw hole. Two bores 98 and 99 pass completely through the projection 93 and parallel to the counterbore 97. A drain plug rod 21 passes through the bore 99. The rod 21 is connected to the knob 20 and operates the drain plug in a conventional manner. A manual override rod 94 passes through the bore 98, and is connected to the knob 20 for operating the faucet 10 in the event of a power failure, in the manual override mode.

An additional module (not shown) could be inserted between the upper and lower modules 12 and 14, changing the height and overall appearance of the faucet 10.

Similarly, in commercial application where water temperatures require uniform setting, one module could be used instead of two, the mixing valve and other plumbing being mounted below the sink.

The spout 34 is secured to a swivel joint connector 84 which is inserted into the inner valve body 51 for rotatable movement with respect to main body 18. The spout 34 can be replaced with a different length spout or a spout which is of a different shape (not shown). The spout 34 has a neck 43 opening downwardly which receives and surrounds an upper flange of the generally tubular joint connector 84 in a fixed connection, as by welding or the like. (FIG. 4).

Figure 6:
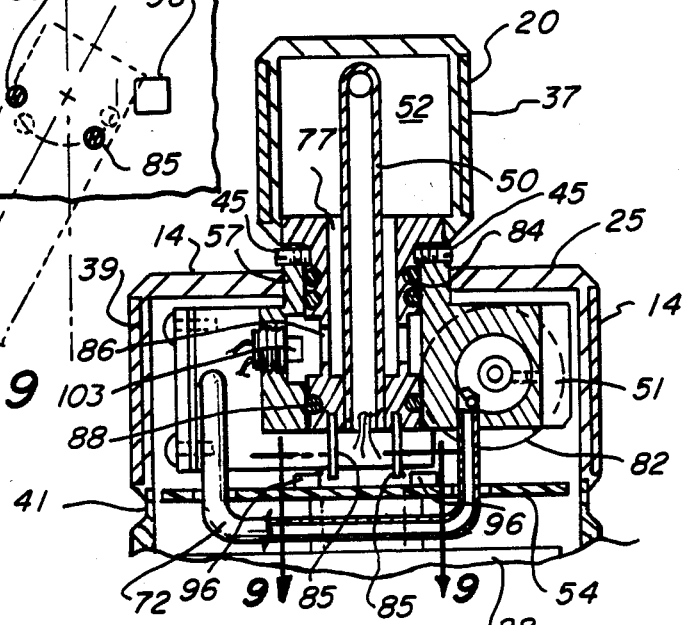
FIG. 6 is a fragmentary sectional view taken in the plane of line 6—6 of FIG. 4.

The connector 84 fits through an opening in the upper module 14 and is rotably held in a connector bore 47 of the inner valve body 51. A circular channel 55 is formed around the connector 84. (FIGS. 4 and 6). A pair of pins 45 are threaded through an upwardly projecting lip 57 of the inner valve body 51, the pin passing into the channel 55 but not touching the connector 84, to rotatably connect the connector 84 to the valve body 51. (FIG. 6). The connector 84 is fixed relative to vertical movement but is swivelable as the pins 45 track in the channel 55.

The connector 84 receives the conduit 50 along a central longitudinal axis of the connector 84. The connector 84 is sealed to the conduit 50 at an end of the conduit protecting the enclosed conductors 48 and preventing water from reaching the control circuit 54, which is secured in any known manner to the inner valve body 51 immediately below the connector. (FIG. 4).

Several openings 86 are formed peripherally around the swivel joint connector 84 for admission of water from the inner valve body 51 into a water receiving passageway 77 of the connector 84. Water is then directed to the water chamber 52. O-ring seals 88 are provided sealing the spout connection and preventing water flow to the exterior of the faucet 10 from the chamber 77. Two elongated metal pins 85 project vertically from the bottom of the connector 84 to the area of the control circuit 54 which are detected by the control circuit when the spout 34 assumes the predetermined angular position. Once the angular position is assumed, water flow is forced off.

Water flows out of the chamber 77 of the connector 84 toward the aerator 36 along the chamber 52 to passage **52*a*, where the water flow passes the flow control valve 42. (FIG. 7). The valve 42 is a butterfly type valve pivotally connected to the spout 34 for manual movement by the center connected control knob 40 to fully open or partly restrict water flow through the delivery passage 52*a*. The passage 52*a* provides water flow communication between the channel 52 and the aerator 36. In the automatic and manual modes, water flow rates are controlled by the control valve 42**.

A water supply pipe 56 exits the mixing valve 28 vertically discharging water at the selected temperature into a first water reservoir 60 formed in the inner valve body 51. A throat 49 of the valve body 51 conventionally connects, as by threaded connection to the pipe 56, an o-ring (not shown) sealing the connection. (FIG. 4). A manifold 58 of the valve body 51 defines the reservoir 60. The supply pipe 56 projects from the lower module 12 into the upper module 14 where the manifold 58 and remainder of the valve body 51 are located. A balanced valve 62 (FIG. 5) is closed to prevent water from flowing from the first reservoir 60 until the control circuitry 54 energizes a solenoid 82 to force open a diaphragm 66 of the valve 62. A valve seat 64 is formed integrally with the valve body 51 and projects horizontally away from the first reservoir 60 at a position above the mixing valve 28 and supply pipe 56. The diaphragm 66 contacts the valve seat 64 in a normally closed position. The diaphragm 66 is secured about a circular ridge 67 of the insert body 51, concentric about the valve seat 64, by a perforated retainer 68 held in position by an end plate 71, as will be seen hereafter.

A second water reservoir 70 is defined in a cavity 69 formed in the valve body 51 concentrically about the ridge 67. The cavity 69 is closed off by the end plate 71 and a seal connected in any suitable manner to the valve body 51. The second reservoir is therefore across the diaphragm 66 from the first water reservoir 60. A solenoid conduit 72 passes through the valve body 51 and into the cavity 69 and to the second water reservoir 70. The other end of the solenoid conduit connects into a solenoid chamber 73 of the valve body 51 near a solenoid valve 76 (FIG. 6) and provides fluid communication with a solenoid passageway 74 (FIG. 5) formed in the valve body 51 upon opening of the solenoid valve 76.

A valve member 80 of the solenoid valve 76 is connected to the solenoid 82, for periodic contact with a valve seat 78 formed on the valve body 51. The solenoid 82 is threadably connected into the solenoid chamber 73, which is also integrally formed within the inner body 51. The valve member 80 can move away from the seat 78 into the solenoid chamber 73 to open the water faucet 10, as will now be described.

Activation of the solenoid 82 by the control circuit 54 moves the valve member 80 off of the seat 78 admitting water from the second reservoir 70 into passageway 74 via the solenoid conduit 72 and solenoid chamber 73. The water flows along passageway 74 to the connector 84 and then along the passageway 77 of the connector to the water chamber 52 and finally to the aerator 36. This lowers the water pressure in the second reservoir 70 and allows the water pressure in the first reservoir 60 to force the diaphragm 66 away from the valve seat 64, admitting water into passageway 75 defined between the valve seat 64 and the ridge 67. Water flows along passageway 75 directly to the connector 84, through openings 86 and along passageway 77 to the spout 34 until such time as the solenoid valve 76 is closed. When the solenoid valve 76 closes, pressure equalizes through the inlet port hole 66 in the diaphragm and seats it to stop water flow.

Two Hall effect switches 96 (FIGS. 4, 6 and 9) are mounted on the control circuit 54 below the spout connector 84 near the pins 85 so that a the spout 34 and connector 84 are rotated to a preselected angular position, one of the pins mounted on the connector is aligned with one switch 96. (FIG. 9). Water flow is forced off by the control circuit 54 when the alignment takes place, whatever other conditions exist. This feature allows for cleaning of the sink without activating the faucet 10.

The drain cap knob 20 provides for manual operation of the faucet 10 in case of power failure. (FIG. 4). A spring 92 biases the knob 20 upwardly from the projection 93. The knob 20 is slidable along the projection 93 to open and close the drain plug (not shown) through the connecting rod 21. Pressing the knob 20 downwardly and overcoming the bias in the spring 92 moves the override rod 94 to open the solenoid valve 76 manually, overriding the automatic mode of the faucet 10. (FIG. 4). A tab 95 of the solenoid 82 is connected to the override rod 94. Downward movement of the knob 20, override rod 94 and tab 95 manually operate the solenoid and forces the valve member 80 off the valve seat 78, turning on the faucet 10.

The electronics control circuit 54 is seen in detail in FIG. 10. The microprocessor 100 contains the program means for operating the automatic faucet 10 in the automatic mode; for sensing and detecting false "on" indications; for preventing water flow in the automatic mode when water temperature is in excess of a certain predetermined amount; and for turning the automatic and manual modes off when the spout 34 is swiveled through the predetermined angle.

Figure 11:
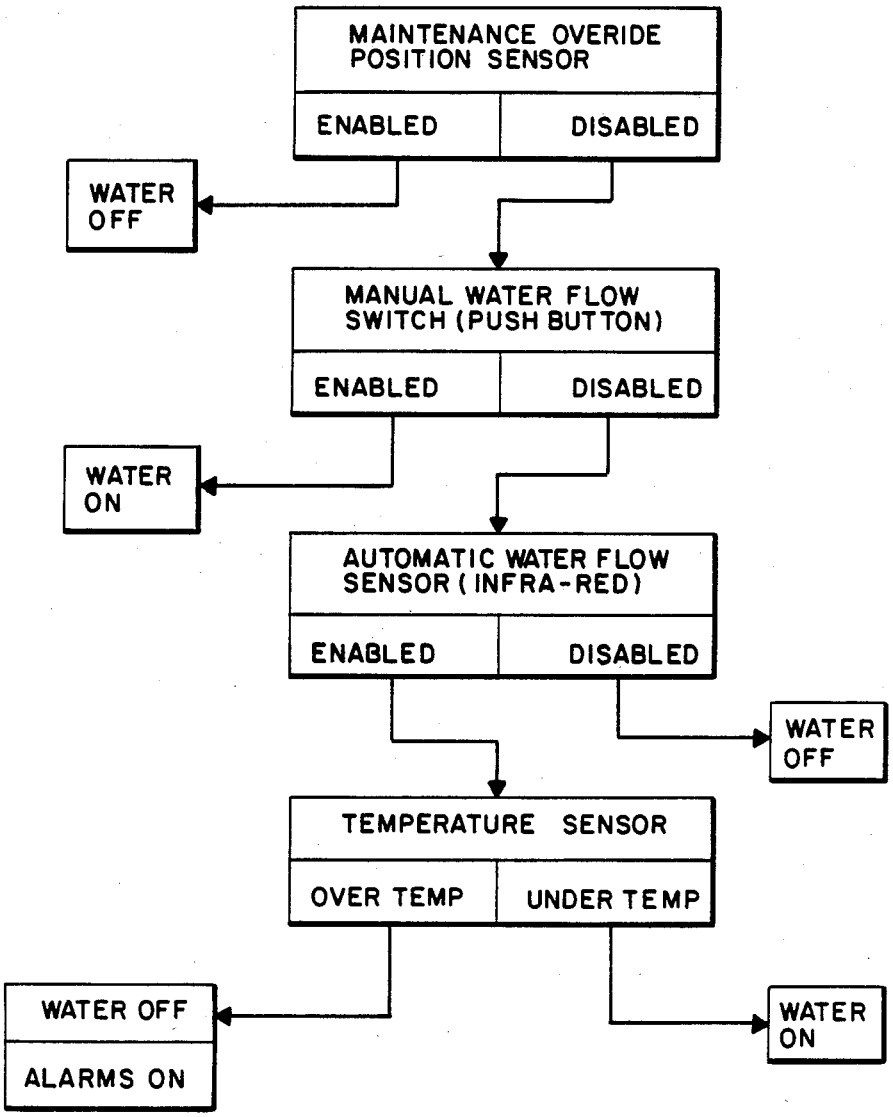
FIG. 11 is a flow chart for a program contained in the circuit of FIG. 10 controlling the temperature of the water supplied.

As seen in FIG. 10 there are various indication or sensor inputs necessary for operation of the microprocesser 100. The Hall effect switches 96, mounted below the connector 84 in the main body 18, are activated by alignment of the pins 85 mounted on the connector 84 with the stationary Hall effect switches 96. This relationship causes an input signal to be sent to the microprocessor 100 indicating the maintenance override position sensor is enabled, in which case the water flow is forced off by the microprocessor 100. (FIG. 11).

If the maintenance override position sensor is not on, then the condition of the manual mode is determined. If the manual mode is on, switch 38 has been activated and water flow is on. In the manual mode, toggling switch 38 from off to on to off turns the water on and then off. (FIG. 7). If the switch 38 is off, the manual mode is disabled, then the faucet is in the automatic mode. Input signals along conductors 106 provide the information upon which the processor 100 determines whether the manual water flow switch 38 is on or off. (FIG. 10).

As seen in FIG. 10, the infrared emitter 104 is periodically activated by the microprocessor 100 along conductor 107. In a like manner, the input from infrared sensor 102 is received initially along conductor 113 by the microprocessor. The solenoid 82 is controlled from the microprocessor 100 by signals carried along conductor 111. The water supply temperature sensor 103 is sampled by the main program along conductor 115. The water temperature warning indicators include the beeper 110 and the LED 112, which produce both audio and visual warnings. The beeper and LED are tied to the microprocessor along conductor 109.

If the manual water flow switch 38 is off, then the faucet 10 is in the automatic mode and the infrared sensor 102 provides the input to the microprocessor 100 which activates the faucet 10. As seen in the main program of FIGS. 13*a* and 13*b*, a predetermined temperature value is compared to temperature input signal supplied along conductor 115, derived from the water supply temperature sensor 103. If the water supply temperature is under the predetermined temperature, then the water is allowed to flow. If the water supply temperature reading is above the predetermined temperature, then the water is forced off by forcing the solenoid 82 closed through the microprocessor 100 and visual LED and audio alarm in the form of the LED 112 and the beeper 110 are turned on by the microprocessor.

Figure 12:
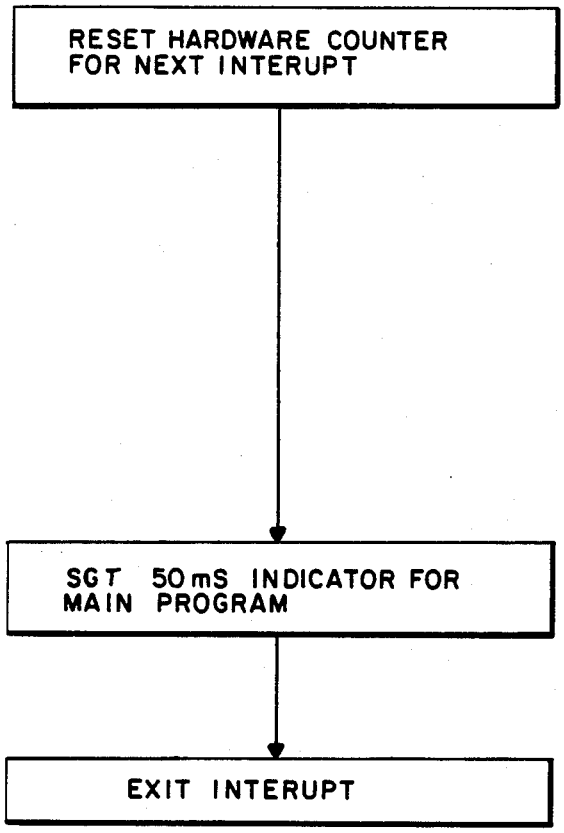
FIG. 12 is a flow chart for an interrupt program contained in the circuit of FIG. 10.

System timing is maintained through the interupt program (FIG. 12). The microprocessor 100 uses an on board programable counter which interupts the main program and initiates the interupt program. This counter is reset each interval to cause the next interupt in 50 msec.

When the interupt program runs, the main program is suspended. A software indicator is set for the main program and upon completion of the interupt program, the main program continues from the point of interuption.

The main program uses the 50 msec indications to generate the 0.25 sec and 0.5 sec, intervals required by program functions with software counters.

Figure 13A:
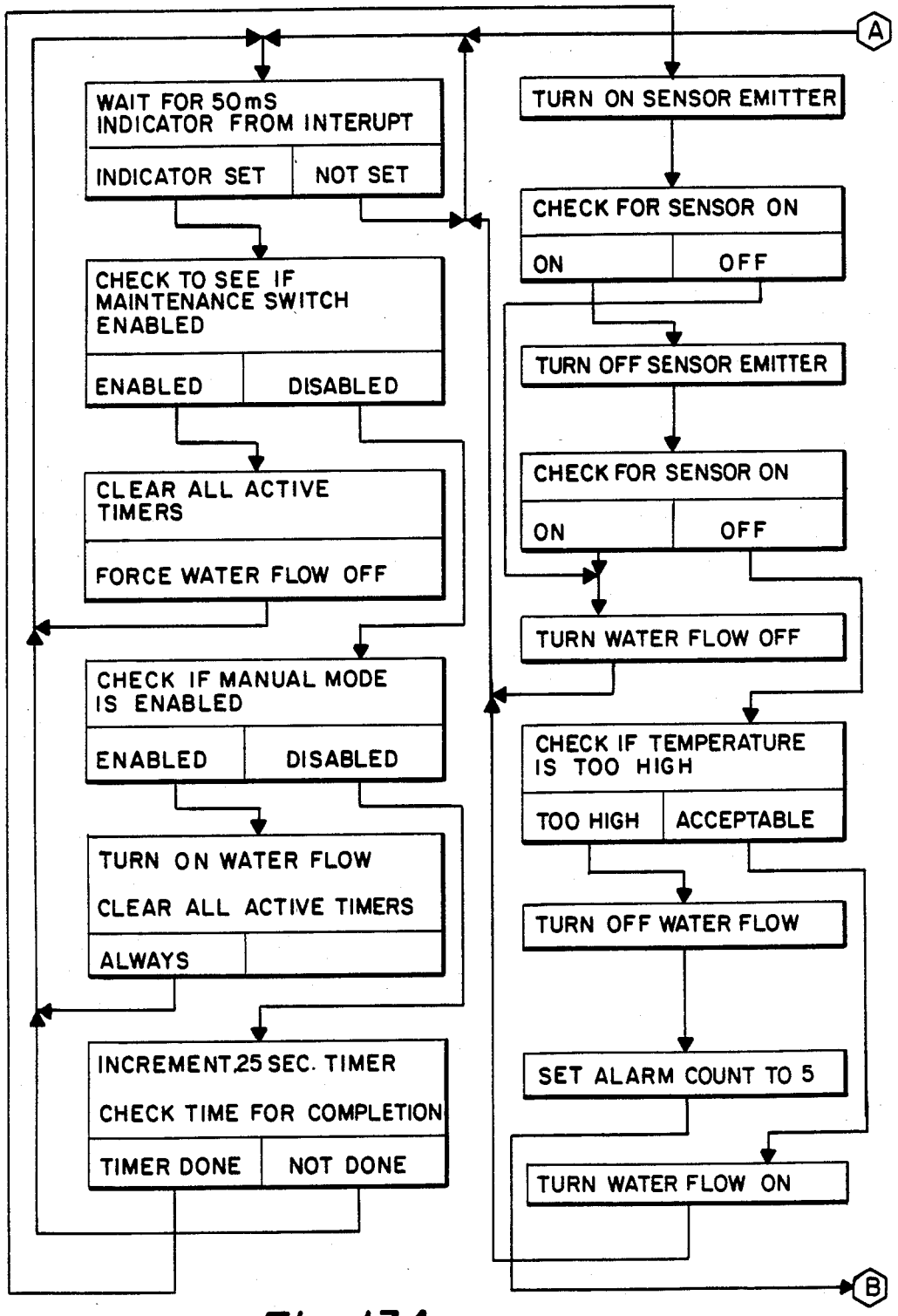
FIGS. 13*a* and 13*b* are flow charts for a main program of the circuit of FIG. 10 controlling the flow of water through the invention shown in FIG. 1.
Figure 13B:
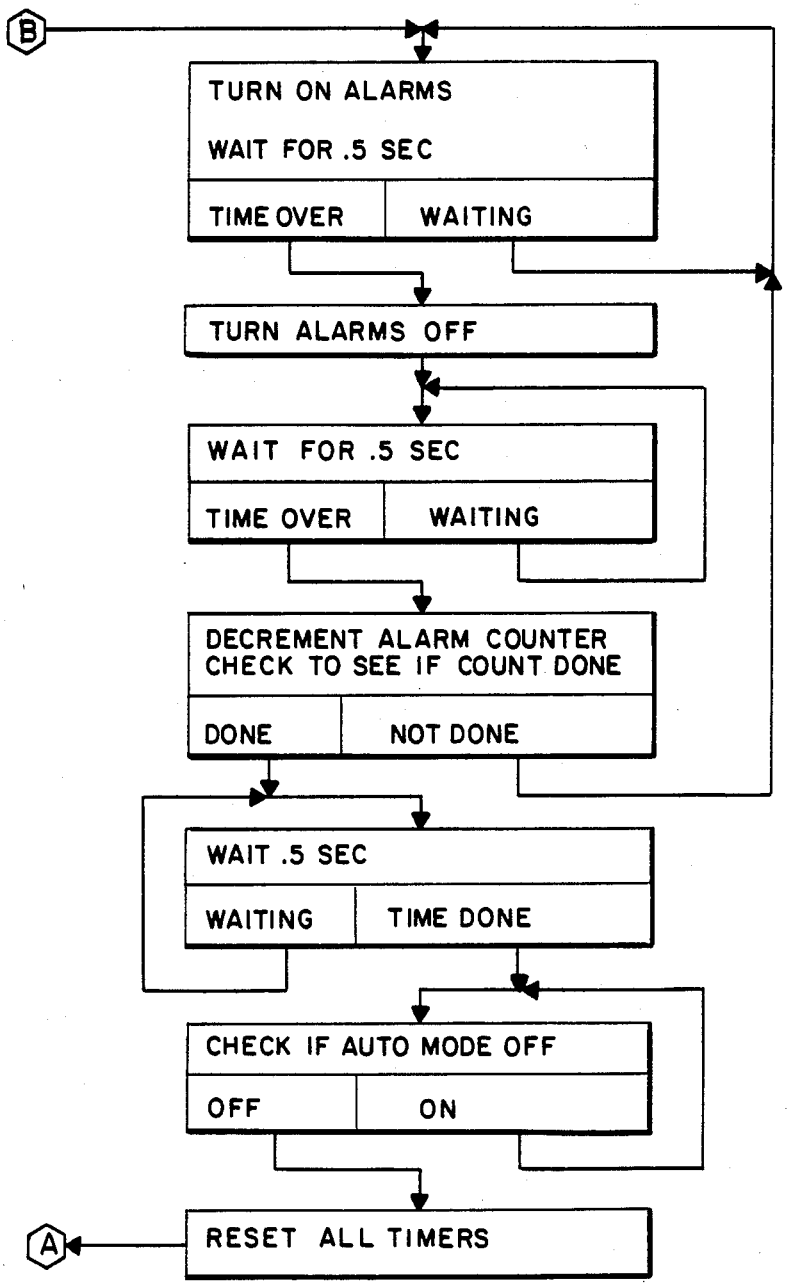

Within the time parameters set by the interrupt program of FIG. 12, the automatic mode of operation is controlled through the circuit 54 and the microprocessor 100 as seen in the main program of FIGS. 13*a* and 13*b*. The indicator, or software flag, from the interrupt program must be set in order to start the automatic mode sequencing of the main program. The maintenance switches or Hall effect switches 96 must be disabled or the water is forced off by the microprocessor 100. The manual mode can be enabled by the manual water flow switch 38 which resets the 0.25 sec counter and turns on the water flow.

If the manual water flow switch is disabled, or off, the timer is set for one quarter second (0.25 sec.) and sensing occurs every 0.25 sec. under the main program for the location of an object near the infrared sensor 102. The main program tests to insure an object has been detected every 50 msec of the 0.25 sec. cycle. Testing is done by activating the sensor 102 when the emitter 104 is off. This is done until the quarter second period is completed and if testing is completed without sensing anything, then the emitter 104 is turned on and the infrared sensor 102 is also turned on.

The emitter 104 is therefore on every 0.25 sec., while the sensor 102 is testing every 50 msec of the 0.25 sec. cycle. When the sensor is turned on and the emitter is turned off, the sensor tests for stray light that might give a false indication. If the sensor 102 generates an input to the microprocessor while the emitter is off, then a false reading has been received, and water flow is forced off. If the sensor 102 receives reflected light when the emitter 104 is on, then the faucet 10 may be activated in the automatic mode. If the sensor remains off, as it should when the sensor emitter 104 is off and the testing portion of the program is implemented, an object has been detected and no false readings are present.

The water supply temperature is then checked to see if it is too high or too low. Too high a temperature requires the microprocessor to force the water flow off and to set the alarm count to 5 or 5 times 50 msec or 0.25 sec. If the temperature is in the acceptable range, the water flow is turned on.

If the available water temperature exceeds the predetermined range for acceptable water temperature, then the alarms are forced on by the microprocessor 100 as seen in FIG. 13*b*. The alarms are turned on for 0.5 seconds and off for 0.5 seconds. If the time has expired and the automatic mode is off, then all timers are reset and the manual water flow switch 38 will turn on the water flow even when the supply temperature exceeds the predetermined temperature. If the automatic mode is on, then the alarms continue to sound and water flow will not be initiated.

Although the invention has been described with a certain degree of particularity, the scope of the invention is defined by the claims as appended hereto and their equivalents.

What is claimed is:

1. A water flow control device activated by the presence of an object near a water outlet of said water flow control device, comprising in combination;

emitter means mounted near said water outlet for periodically transmitting a light signal into the area adjacent the water outlet;

sensor means for receiving reflected light transmitted by said emitter means;

control means for turning on said emitter means at times when said sensor means is on and for turning said sensor means on and off for preselected periods of time during a cycle of time and, if light is sensed by said sensor means when said emitter means is off, said control means then preventing the water flow control device from turning on, and, if no light is sensed by said sensor means when said emitter means is off and the reflected light is sensed by said sensor means when said emitter means is on, said control means then turning on the water flow control device.

2. The invention as defined in claim 1 wherein said control means turns the sensor means on periodically every 50 msec and said emitter means is turned on every 0.25 sec.

3. The invention as defined in claim 1 wherein said control means further includes position detecting means for forcing the water flow control device off when the outlet is in a certain position relative to a normal operating position.

4. The invention as defined in claim 1 wherein said control means further includes warning means for comparing a water supply temperature to a predetermined temperature and forcing said water flow control device off if said supply temperature is greater than said predetermined temperature.

5. The invention as defined in claim 4 wherein said warning means further includes means for supplying audio and visual indications if said supply temperature exceeds said predetermined temperature.

6. The invention as defined in claim 5 wherein a switch will turn on the water flow control device.

7. The invention as defined in claim 4 wherein said control means further includes a manually actuated switch said switch has an input to said control means for turning said water flow control device on whatever the water supply temperature.

8. A water flow control device activated by the presence of an object near a water outlet of said water flow control device, comprising in combination:

detection means, including an emitter transmitting a signal into the area adjacent water outlet and a sensor for receiving a reflected signal transmitted by said emitter, both being, mounted on said spout near said outlet and control means for turning said sensor on and off for preselected periods of time during a cycle of time and, if the sensor is on when the emitter is off, said control means then preventing the water flow control device from turning on, and, if the sensor is off when the emitter is off and the sensor is on when the emitter is on, said control means then turning on the water flow control device.

9. The invention as defined in claim 8 wherein said control means further receives an input signal indicating a predetermined angular position of the spout relative to the main body, said control means deactivating said detection means for operating said valve means upon the receipt of said input signal indicating a predetermined angular position.

10. The invention as defined in claim 8 wherein said control means further receives an input signal indicative of the water supply temperature, which temperature is compared by said control means to a predetermined temperature, and if in excess of said predetermined temperature, said control means deactivates the control means for operating said valve means, preventing flow of water when an object is near the outlet of said spout; and a manually-actuated switch for opening and closing said valve through said control means when said water supply temperature is in excess of said predetermined temperature.

11. A faucet for dispensing water, said faucet receiving water from a water supply, comprising in combination:

a main body operatively connected to a spout, said main body including a plurality of interconnected, generally-hollow tubular modules, a base module receiving said water supply therein; said spout having planar surfaces in parallel planes to the surfaces of said module and said spout and said modules include means for mounting decorative panels thereon to define some of said surfaces, a generally cubically-shaped drain cap knob slideably mounted to said main body having at least some outer surfaces in parallel planes with the outer surfaces of said modules and said spout, said knob operatively connected to a valve for opening and closing said water supply, said knob opening and closing said valve upon movement of said knob on said main body; and control means for sensing the presence of an object near said outlet of said spout and opening said valve in response thereto.

* * * * *